United States Patent [19]

Handler et al.

[11] Patent Number: 4,768,660

[45] Date of Patent: Sep. 6, 1988

[54] ADJUSTABLE HOOK AND MOUNTING RAIL ASSEMBLY

[75] Inventors: Milton E. Handler, Northbrook; Michael Peterson, Evanston, both of Ill.

[73] Assignee: Hirsh Company, Skokie, Ill.

[21] Appl. No.: 61,783

[22] Filed: Jun. 11, 1987

[51] Int. Cl.[4] ..... A47F 5/08

[52] U.S. Cl. ..... 211/87; 211/96; 248/220.2; 248/222.1

[58] Field of Search ..... 248/222.1, 220.4, 221.1, 248/221.2, 221.3, 221.4, 222.2, 220.3, 220.2; 211/87, 96, 94

[56] References Cited

U.S. PATENT DOCUMENTS

| | | | |
|---|---|---|---|
| 1,335,881 | 4/1920 | Dottl | 248/222.1 |
| 2,471,839 | 5/1949 | Schumacher | 248/222.1 |
| 3,037,733 | 6/1962 | Roman | 248/222.1 X |
| 3,452,954 | 7/1969 | Lucietto et al. | 248/221.1 |
| 4,304,382 | 12/1981 | Jelen | 248/221.1 |
| 4,405,110 | 9/1983 | Gibbons | 248/221.2 |
| 4,506,856 | 3/1985 | Rich et al. | 248/222.1 |
| 4,607,753 | 8/1986 | Radek | 211/87 |
| 4,619,428 | 10/1986 | Bailey | 248/222.1 X |

*Primary Examiner*—Ramon O. Ramirez

*Attorney, Agent, or Firm*—Dressler, Goldsmith, Shore, Sutker & Milnamow, Ltd.

[57] ABSTRACT

A storage assembly is provided with at least one adjustable hook for engaging a support rail which can be attached to a vertical surface, such as a wall. Each hook has two cantilever engaging members which are engaged with the rail through T-shaped apertures. The hooks are easily inserted into, or removed from, the support rail by deflecting one of the cantilever members.

4 Claims, 3 Drawing Sheets

FIG. 8
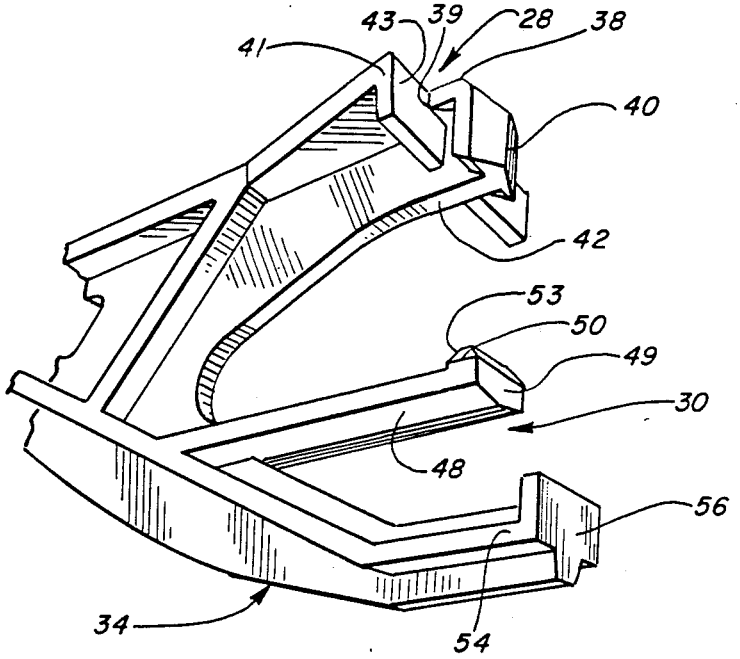
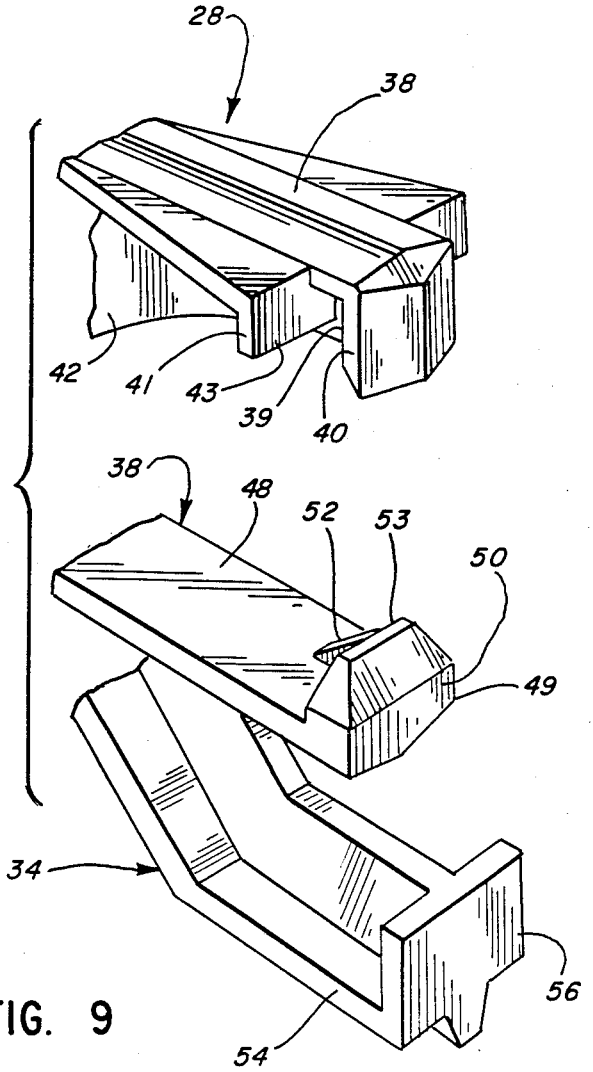
FIG. 9
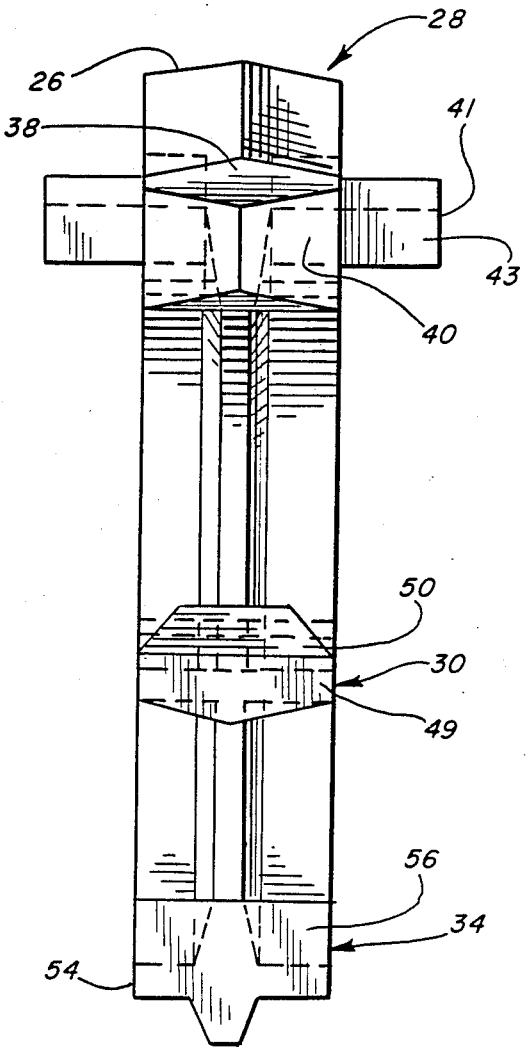
FIG. 10

ADJUSTABLE HOOK AND MOUNTING RAIL ASSEMBLY

TECHNICAL FIELD

This invention relates to wall-mounted storage devices and more particularly to a wall-mounted hook and rail assembly that is readily adjustable for use in storing and organizing a variety of tools and equipment.

BACKGROUND OF THE INVENTION AND TECHNICAL PROBLEMS POSED BY THE PRIOR ART

Storage of tools and equipment in garages and workshops is a common problem. There have been a variety of products introduced in the nature of hooks and racks which are designed for use in retaining and holding different types of common equipment, such as brooms, rakes, saws, etc.

For example, there are various types of conventional hooks that can be fastened directly into a wall. These products can be glued or threaded into a wall and provide a semi-permanent or permanent installation. The location of such hooks cannot readily changed.

Another common organizing device is the conventional assembly of a pegboard and hooks. Pegboards have an array or grid of equally spaced identical openings which accept a variety of sizes and shapes of hooks. The pegboard hooks are readily adjustable on the pegboard. Pegboard systems are limited because the pegboard must stand away from the wall a certain distance so that the hook can be received by the pegboard. This requires a suitable special mounting structure. Additionally, pegboard hooks have a tendency to fall out of the pegboard, or at least move somewhat, when the tool that is hanging on the hook is removed.

It would be desirable to provide an improved storage device that avoids the above-discussed disadvantages. Further, it would be desirable to provide such an improved device with the features of easy adjustability, rigidity, and versatility in a wall-mounted tool organizer assembly. It would be especially beneficial if such an improved tool organizer assembly could be provided with features that would accommodate a variety of users and applications.

SUMMARY OF THE INVENTION

In accordance with the present invention, there is provided an adjustable hook and wall-mounted rail assembly which is simple, low in cost, and readily installable on any vertical wall. This assembly provides an easily adjustable means for organizing and storing equipment.

More specifically, the adjustable hook and mounting rail assembly comprises a mounting or support rail and at least one hook which mounts into the rail. The mounting rail, in the preferred embodiment, is typically secured to a vertical wall. The mounting rail has two rows of spaced-apart apertures: an upper row and a lower row.

Each adjustable hook mounts into the support rail by means of upper and lower engaging means. The upper engaging means is received in an aperture in the upper row of apertures. The lower engaging means is received in an aperture in the lower row of apertures. The lower engaging means is deflectable in a direction opposite the upper engaging means to enable the lower engaging means to be engaged with, or a disengaged from, the mounting rail.

In the preferred embodiment, the adjustable hook also has a bottom bearing member which is spaced below the lower engaging means and rests against the mounting rail to provide for additional stability.

Numerous other advantages and features of the invention will become readily apparent from the following detailed description of the invention and from the embodiments illustrated herein, from the claims and from the accompanying drawings.

BRIEF DESCRIPTION OF THE DRAWINGS

FIG. 8 is an enlarged, fragmentary, perspective view of the underside of the adjustable hook (looking up from below);

FIG. 9 is an enlarged, fragmentary, perspective view of the top of the adjustable hook (looking down from above);

FIG. 10 is an enlarged, rear elevational view of the adjustable hook; and

DESCRIPTION OF THE PREFERRED EMBODIMENTS

While this invention is susceptible of embodiment in many different forms, this specification and the accompanying drawings disclose only some specific forms as an example of the use of the invention. The invention is not intended to be limited to the embodiments so described, and the scope of the invention will be pointed out in the appended claims.

Figure 2:
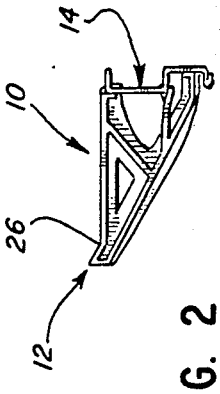
FIG. 2 is a side elevational view of the mounting rail hook assembly.
Figure 1:
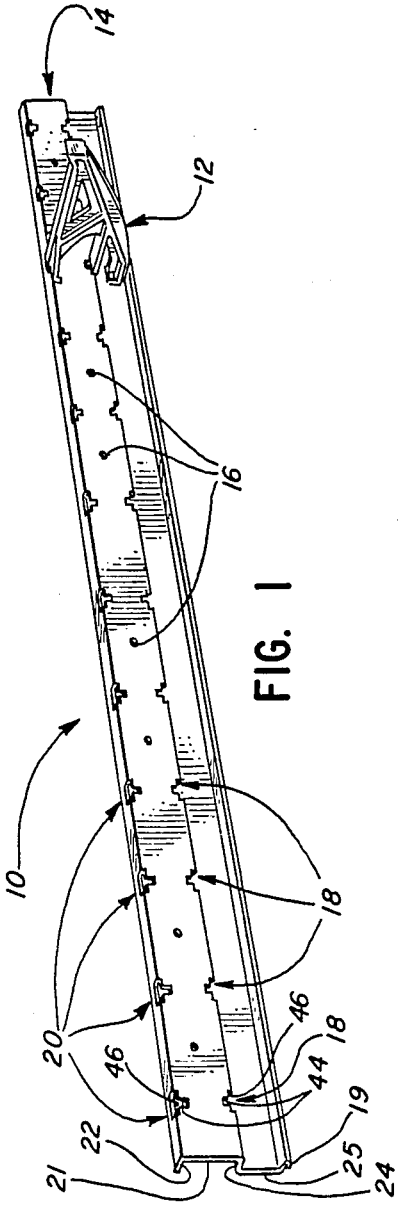
FIG. 1 is a perspective view of the adjustable hook and mounting rail assembly of the present invention with an adjustable hook shown inserted in the mounting rail.
Figure 3:
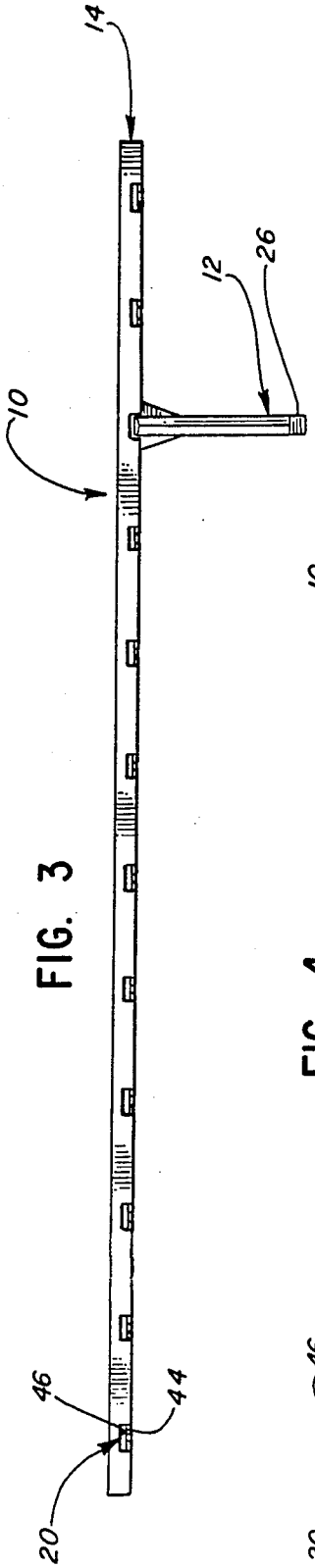
FIG. 3 is a top elevational view of the mounting rail and hook assembly.
Figure 4:
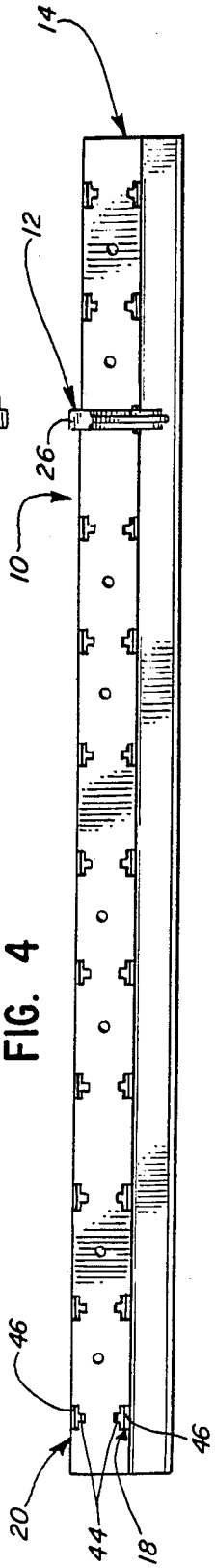
FIG. 4 is a front elevational view of the mounting rail and hook assembly.
Figure 5:
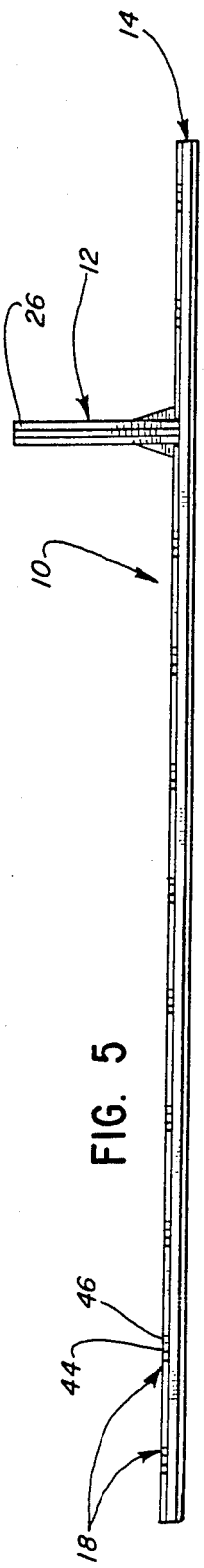
FIG. 5 is a bottom elevational view of the mounting rail and assembly.

The adjustable hook and rail assembly of the present invention is designated in FIG. 1 generally by the reference numeral 10. The assembly 10 includes the mounting rail 14 and at least one adjustable hook 12. Although only one hook 12 is illustrated in the preferred embodiment in FIGS. 1–7, it is contemplated that a plurality of such adjustable hooks 12 would typically be provided.

The mounting rail 14 is secured to a generally vertical surface, such as a wall or the like, by means of suitable fasteners 15 (FIG. 6A) through mounting holes 16 (FIG. 1). The holes 16 accept a variety of fastners to secure the mounting rail 14 to a wall. Alternatively, adhesive can be used to secure the rail 14 to the wall.

The mounting rail 14 defines an upper row of spaced-apart apertures 20 and a lower row of spaced-apart apertures 18. The mounting rail 14 includes a top horizontal wall 22 (FIGS. 6A and 6B) and an upper vertical wall 21 (FIG. 6B) extending downwardly from the front edge of the top horizontal wall 22. As best illustrated in FIG. 6A, the vertical wall 21 has an inwardly facing interior surface 23 and an outwardly facing exterior surface 27. The rail 14 further includes a bottom horizontal wall 24 extending from the bottom edge of the upper vertical wall 21 in registry with the top horizontal wall 22 and a lower vertical wall 25 extending downwardly from the bottom horizontal wall 24. A rolled lip 19 is also provided at the bottom of the lower wall 25.

Each of the apertures 18, 20 is a generally T-shaped slot having a vertical stem portion 44 and a horizontal portion 46. The vertical stem portions 44 of the apertures 18, 20 are defined entirely in the upper vertical wall 21. The apertures 18 in the lower row are inverted relative to the upper row of apertures 20.

The horizontal portion 46 of each aperture 20 in the upper row of apertures 20 is defined partly in the rail vertical wall 21 and partly in the rail top horizontal wall 22 as best illustrated in FIG. 1. The horizontal portion 46 of each aperture 18 in the lower row of apertures 18 is defined partly in the rail vertical wall 21 and partly in the rail bottom horizontal wall 24.

The adjustable hook 12 includes an outwardly projecting support portion 26 (FIG. 2) for supporting an object hung therefrom, and the adjustable hook 12 is adapted to be engaged in the upper and lower rows of apertures 20,18, of the rail 14. To this end, the adjustable hook 12 (FIG. 6A and 6B) has an upper engaging means or an upper cantilever member 28 which is receivable in one of the upper row apertures 20 on the mounting rail 14. The hook 12 also has a lower engaging means or an lower cantilever member 30 which is receivable in one of the lower row apertures 18 on the mounting rail 14.

The upper engaging means 28 includes a projecting plate 38 (FIGS. 8 and 9) with a primary flange 40 at the end of the plate 38 defining an upper primary engaging surface 39 which faces outwardly toward the projecting support portion 26 and which is generally perpendicular to the plate 38. The surface 39 is adapted to be received adjacent the surface 23 of the rail vertical wall 21 in a manner described in detail hereinafter.

The upper engaging means 28 also includes a rib 42 generally perpendicular to, and connected with, both the projecting plate 38 and the flange 40. The upper cantilever member 28 also includes a secondary flange 41 that is parallel to, but spaced outwardly from, the primary flange 40. The flange 41 has a secondary engaging surface 43 parallel to the primary flange 40 and is adapted to be received adjacent the exterior surface 27 of the rail vertical wall 21 in a manner described in detail hereinafter.

The lower engaging means 30 comprises a projecting plate 48 and a flange 50 at the end of the plate 48. The flange 50 defines a primary lower engaging surface 49 facing away from the outwardly projecting support portion 26. The surface 49 is generally perpendicular to the plate 48.

The lower engaging means 30 further includes a rib 52 generally perpendicular to, and connected with, both the projecting plate 48 and the flange 50. The flange 50 also has a secondary lower engaging surface 53 which is adapted to engage the surface 23 of the rail vertical wall 21 in a manner described in detail hereinafter.

The lower engaging member 30 is resiliently deflectable in the downward direction for purposes described in detail hereinafter.

The hook 12 also preferably includes a bottom bearing member 34 spaced below the lower cantilever member 30. This functions to provide increased support for the hook 12 in a manner described in detail hereinafter. The bottom bearing member 34 includes a projecting plate 54 and an upstanding flange 56 at the end of the projecting plate 54.

Figure 6B:
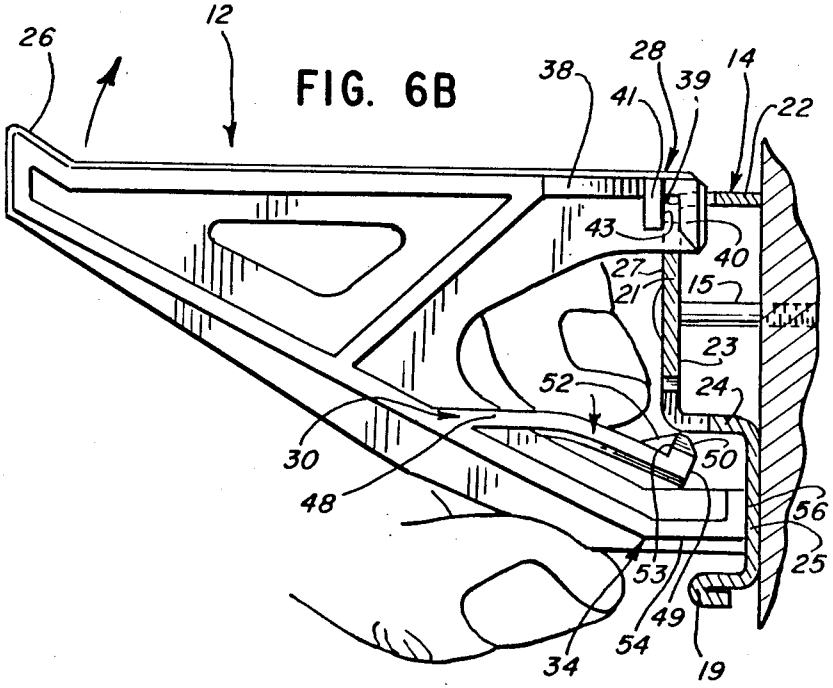
FIG. 6B is a view similar to FIG. 6A, but showing deformation of the hook to facilitate removal from, or attachment to, the mounting rail.
Figure 7:
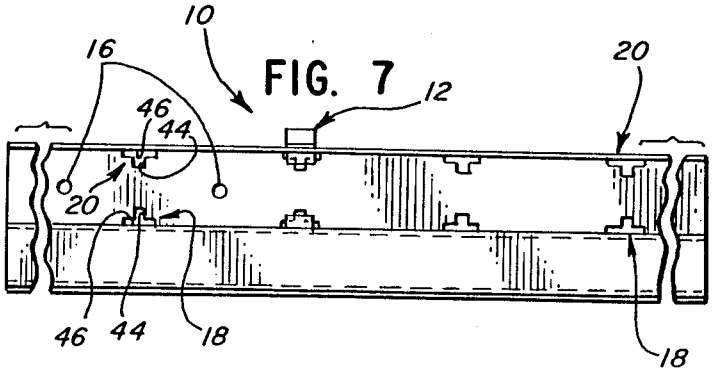
FIG. 7 is a rear elevational view of the mounting rail and hook assembly.
Figure 6A:
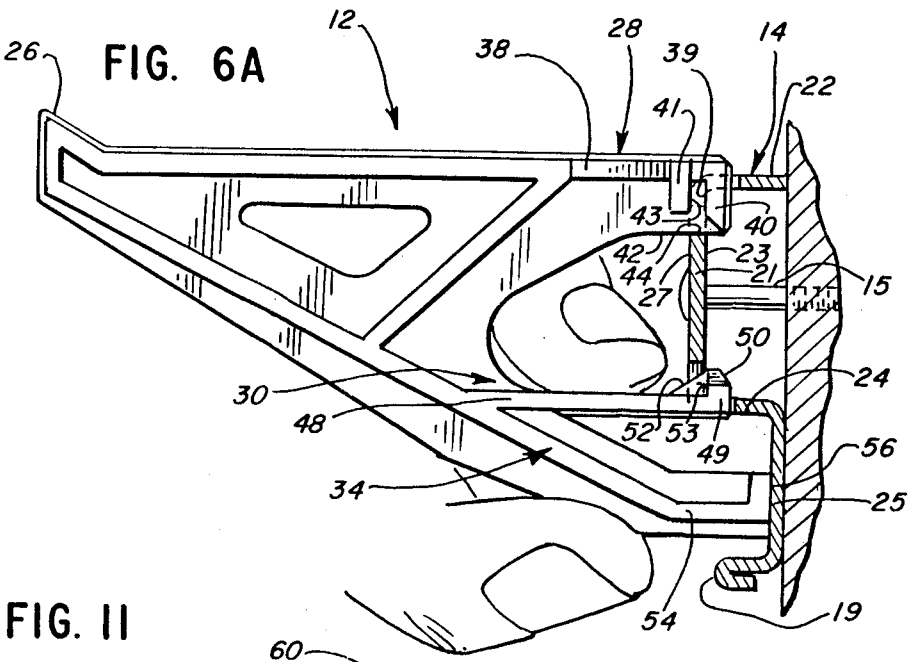
FIG. 6A is an enlarged, partial cross-sectional view of the adjustable hook installed in the mounting rail.

To insert the adjustable hook 12 into the mounting rail 14, the upper cantilever member 28 must first engage the mounting rail around the periphery of one of T-shaped apertures in the upper row of apertures 20 (see FIG. 6B). More specifically, the flange 40 is inserted downwardly into the horizontal portion 46 of the aperture 20. This results in the primary engaging surface 39 of the flange 40 being disposed adjacent the interior surface 23 of the upper vertical wall 21 at the periphery of the aperture 20.

Additionally, the hook 12 is restrained downwardly when the bottom of the rib 42 engages the bottom of the aperture vertical stem portion 44 (FIG. 6A). (If desired, the components may be alternatively designed so that the lower surface (undersurface) of the projecting plate 38 engages the edge of the wall 21 at the lower periphery of the horizontal portion 46).

Further, it is to be noted that the engaging surface 43 of the flange 41 becomes disposed adjacent the exterior surface 27 of the rail wall 21 around the aperture 20. It is thus seen that the upper engaging member 28 is restrained from movement rearwardly, forwardly, and downwardly.

The next step in the insertion of the hook 12 is to engage the lower cantilever member 30 with the rail 14 at an aperture 18 in the lower row of apertures 18. In the illustrated embodiment, the member 30 is deflected, by one's finger, in a downward motion away from the upper cantilever member 28. The deflection permits the flange 50 to clear the front of the upper vertical wall 21 and be moved rearwardly below the aperture 18. While holding the member 30 in the deflected orientation, the adjustable hook 12 is pivoted (counterclockwise as viewed in FIG. 6A) rearwardly toward the rail 14 to position the flange 50 in registry below the aperture 18. The cantilever member 30 is then released so that it returns to its original position thereby engaging the rail 14 at the periphery of the aperture 18.

As seen in FIG. 6A, the engaged lower cantilever member 30 is surrounded by the T-shaped aperture 18. The rib 52 (FIG. 9) is received in the stem portion 44 of the T-shaped aperture 18. The flange 50 is received in the horizontal portion 46 of the aperture. The primary lower engaging surface 49 is disposed adjacent the wall 24 and the secondary lower engaging surface 53 is disposed adjacent the surface 23 of the wall 21.

Once the lower cantilever member 30 is inserted in the rail 14, the hook 12 is locked into position. When an item which is hung from the hook 12 is removed, the secondary lower engaging surface 53 contacts the interior vertical wall surface 23 which prevents the front of the hook 12 from being lifted up along with the item being removed (i.e., prevents clockwise rotation of the hook as viewed in FIG. 6A).

The bottom bearing member 34 rests against the lower vertical wall 25 to provide additional rigidity and support. The positioning of the flange 56 against the lower vertical wall 25 provides the additional stability without disfiguring the wall to which the mounting rail 14 is attached.

Figure 11:
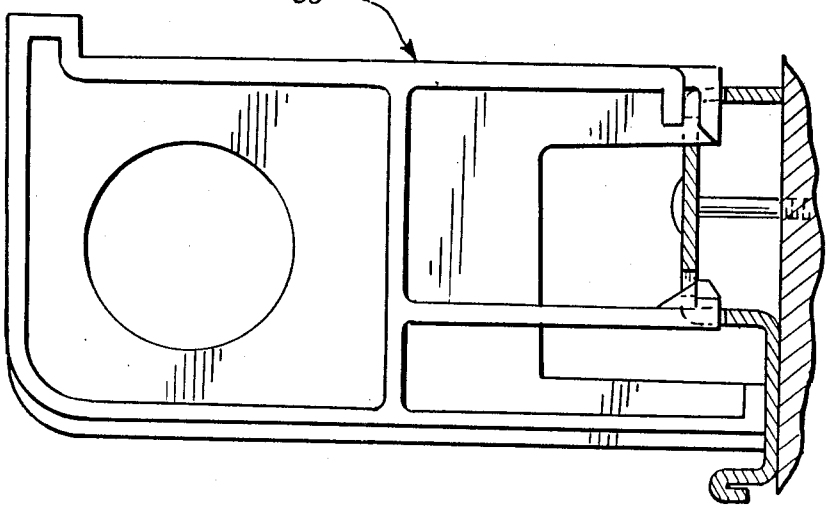
FIG. 11 is a view similar to FIG. 6A, but showing an alternate embodiment of the adjustable hook.

FIG. 11 shows an alternate embodiment of an adjustable hook 60. The alternate embodiment hook 60 is inserted in the same manner, and mechanically functions in the same manner, as the first embodiment hook 12 described above. The illustration of alternate embodiment hook 60 serves to show how the principles of this invention may be incorporated in a structure having a different shape and different aesthetic design.

It will be readily observed from the foregoing detailed description of the invention and from the illustrated embodiments thereof that numerous variations and modifications may be effected without departing from the true spirit and scope of the novel concepts or principles of this invention.

What is claimed is:

1. An adjustable hook and mounting rail assembly comprising:

a mounting rail for being secured to a generally vertical surface, said rail defining an upper row of spaced-apart apertures and defining a lower row of spaced-apart apertures, said rail having (1) a top horizontal wall, (2) an upper vertical wall extending from the front edge of said top horizontal wall, and (3) a bottom horizontal wall extending from the bottom edge of said vertical wall in registry with said top horizontal wall, each of said aperture being a T-shaped slot having a stem of the T-shape defined in said upper vertical wall and having at least a portion of the horizontal portion of the T-shaped slot defined in one of said top and bottom horizontal walls; and a hook for being mounted to said rail, said hook having an outwardly projecting support portion for supporting an object hung therefrom, said hook further having an upper engaging means for being received in one of said upper row apertures to engage said rail at the periphery of said one upper row aperture, said hook further having a lower engaging means spaced below said upper engaging means for being received in one of said lower row apertures to engage said rail at the periphery of said one lower row aperture, said lower engaging means being deflectable downwardly out of said one lower row aperture, each said hook upper and lower engaging means having (1) a projecting plate, (2) a flange at the end of the plate defining an engaging surface generally perpendicular to the plate, and (3) a rib generally perpendicular to, and connected with, both said plate and said engaging surface.

2. A support rail and adjustable hook assembly comprising:

an elongated support rail for being secured to a generally vertical surface and defining an upper row of spaced-apart apertures and a lower row of spaced-apart apertures; and a removable adjustable hook which includes an upper cantilever member for being attached to said rail at one of said upper row apertures, said upper cantilever member including (1) a projecting plate, (2) a primary flange at the end of the plate defining a primary engaging surface generally perpendicular to the plate, (3) a secondary flange defining secondary engaging surface generally perpendicular to the plate and spaced from, but parallel to, the primary flange, and (4) a rib generally perpendicular to, and connected with, said plate and said primary and secondary flanges, said adjustable hook further having a flexible lower cantilever member which is deflectable to facilitate attachment of said lower flexible cantilever member to said rail at one of said lower row apertures.

3. The support rail and adjustable hook assembly in accordance with claim 2 in which said support rail has an interior upper vertical surface for facing the wall to which it is mounted and an exterior upper vertical surface for facing away from said wall; and in which said primary and secondary engaging surfaces are positionable adjacent said interior and exterior vertical surfaces, respectively.

4. A support rail and adjustable hook assembly comprising:

an elongated support rail for being secured to a generally vertical surface and defining an upper row of spaced-apart apertures and a lower row of spaced-apart apertures, said support rail including a lower vertical wall beneath said lower row of spaced-apart apertures; and a removable adjustable hook which includes an upper cantilever member for being attached to said rail at one of said upper row apertures, said adjustable hook further having a flexible lower cantilever member which is deflectable to facilitate attachment of said lower flexible cantilever member to said rail at one of said lower row apertures, said adjustable hook further including a bottom bearing member spaced below said lower cantilever member, said bottom bearing member including (1) a projecting plate, and (2) a flange at the end of said plate defining a bearing surface generally perpendicular to the plate for bearing against said support rail lower vertical wall.

* * * * *